US006863432B2

(12) United States Patent
Schuchardt et al.

(10) Patent No.: US 6,863,432 B2
(45) Date of Patent: Mar. 8, 2005

(54) DYNAMIC MIXER

(75) Inventors: Heinrich Schuchardt, Leverkusen (DE); Klemens Kohlgrüber, Kürten (DE)

(73) Assignee: Bayer Aktiengesellschaft, Leverkusen (DE)

( * ) Notice: Subject to any disclaimer, the term of this patent is extended or adjusted under 35 U.S.C. 154(b) by 85 days.

(21) Appl. No.: 10/351,241

(22) Filed: Jan. 24, 2003

(65) Prior Publication Data

US 2003/0147304 A1 Aug. 7, 2003

(30) Foreign Application Priority Data

Jan. 25, 2002 (DE) ..... 102 02 800
Oct. 17, 2002 (DE) ..... 102 48 333

(51) Int. Cl.[7] ..... B01F 7/00
(52) U.S. Cl. ..... 366/299; 366/301; 366/309; 366/310
(58) Field of Search ..... 366/292, 297, 366/298, 299, 300, 301, 309, 310, 311, 312, 313

(56) References Cited

U.S. PATENT DOCUMENTS 1,733,516 A * 10/1929 Jamieson et al. ..... 366/300
3,482,823 A * 12/1969 Rechtin ..... 366/245
3,659,826 A * 5/1972 Nauta ..... 366/287
3,861,656 A 1/1975 Schmitt ..... 259/118
4,198,376 A * 4/1980 Fournel et al. ..... 366/297
5,090,815 A 2/1992 Bohle ..... 366/192
5,123,748 A * 6/1992 Schroer ..... 366/287
5,372,617 A * 12/1994 Kerrebrock et al. ..... 366/310
5,890,803 A * 4/1999 Jolink ..... 366/287

FOREIGN PATENT DOCUMENTS

| | | |
|---|---|---|
| DE | 199 36 302 | 8/1999 |
| FR | 2 716 337 A1 | 8/1995 |
| FR | 2 757 350 A1 | 6/1998 |
| WO | WO 99/66329 | 12/1999 |

* cited by examiner

*Primary Examiner*—Tony G. Soohoo
(74) *Attorney, Agent, or Firm*—Norris McLaughlin & Marcus PA

(57) ABSTRACT

Mixer comprising a housing having filling and emptying openings, two corotating stirrers and drivers for the stirrers, one of the stirrers being arranged centrally in the housing and having at least a drive shaft and at least one transverse beam fitted to the drive shaft and at least one stirring arm fitted at their ends to the transverse beam.

20 Claims, 7 Drawing Sheets

DYNAMIC MIXER

This invention relates to a mixer comprising at least a housing with supply and discharge openings, two corotating stirrers and at least one drive for moving the stirrers, wherein one stirrer is arranged centrally in the housing, and has at least one drive shaft, at least one transverse beam fitted to the drive shaft of the centrally arranged stirrer and at least one, preferably at least two, stirring arms fitted on the ends of the at least one transverse beam(s)

BACKGROUND OF THE INVENTION

For mixing liquids and solids, mixers in which kinematic cleaning of the surfaces is performed by the mixing elements are often used to avoid deposits on walls and stirring mechanisms. Examples of such devices are twin-screw corotating extruders.

For processes involving relatively high-residence times, mixers with large free volumes are furthermore required. An example of an apparatus which satisfies this requirement is described in European Patent Application EP 0 917 941 A1 (U.S. Pat. No. 6,033,103).

For cleaning the surfaces of such mixers as completely as possible, two degrees of freedom are required. This requirement is met in the case of the apparatus according to EP 0 917 941 A1 (U.S. Pat. No. 6,033,103) by the use of two drive shafts.

In the case of a type of mixer referred to as a Buss-Ko kneader (cf. Mischen beim Herstellen und Verarbeiten von Kunststoffen [Mixing during the production and processing of plastics], published by the Association of German Engineers, VDI-Ges. Kunststofftechnik, Dusseldorf, 1986, page 200), an axially oscillating motion of the kneader shafts is superimposed on a rotational motion.

For high-pressure processes, apparatuses with octagonal housings (see for example EP 0 917 941 A1=U.S. Pat. No. 6,033,103) are unsuitable.

Furthermore, for batch processes, apparatuses with good axial mixing are required.

Consequently, a mixer with a cylindrical housing and which, in the product region, provides good, and in particular axial mixing and which, in particular is, as far as possible, completely self-cleaning, is needed.

Such a mixer is provided by the present invention.

SUMMARY OF THE INVENTION

The present invention relates to a mixer which comprises at least a housing with filling and emptying openings, two corotating stirrers and drives for moving the stirrers, wherein one stirrer is arranged centrally in the housing, and comprises at least one drive shaft, with at least one, preferably at least two, transverse beams fitted on the at least one drive shaft and at least one, preferably at least two, stirring arms fitted in each case at their ends of the transverse beam(s), and wherein the other stirrer comprises at least one drive shaft and one or more stirring blades and is arranged eccentrically in the housing.

DETAILED DESCRIPTION

In a preferred embodiment, the invention provides a mixer in which, in the course of the rotation of the stirrers brought about by the drivers, the stirring blades and the stirring arms brush over one another, with the exception of their end faces, which end faces, optionally, brush over the inside wall of the housing.

The stirring arms are, in particular, extended in the longitudinal direction of the stirrer shaft.

The corotating stirrers can each have individual drives, or they can share a common drive.

A mixer in which the stirring blades and the stirring arms are helically shaped is preferred. Good axial mixing is thereby achieved.

In a preferred embodiment, the stirrers are rotationally symmetrical, as described below.

Virtually complete mutual cleaning is achieved if the symmetry of the stirrers with respect to the rotational speed of their shafts conforms to the following mathematical relationship (I):

$$\frac{\omega_1}{\omega_2} = \frac{n_2 j}{n_1 i}, \tag{I}$$

in which $n_1$ denotes the rotational symmetry of the central stirrer, $n_2$ denotes the rotational symmetry of an engaging eccentric stirrer, $\omega_1$ denotes the rotational speed of the central shaft, $\omega_2$ denotes the rotational speed of the eccentric shaft and i and j are natural numbers.

A mixer for which in formula (I) the number j=1 and the number i=1 is particularly preferred.

For i=1 and j=1 in formula (I), customary internal toothing is obtained. Various other forms of toothing are also possible, for example involute toothing.

A form of the mixer in which in formula (I) the number j=1 and i is >1, with i being prime to $n_2$, is also particularly preferred.

A variant of the mixer which is characterized in that in formula (I) the number j is >1 and the number i is >1, with i being prime to $n_2$ and j being prime to $n_1$, is very particularly preferred.

For inexpensive production, a toothing in which the stirring blades have a thickness which is constant over the radius is preferred. The stirring blades may then be formed, for example, from sheet metal.

Furthermore, inexpensive production is made easier if the number of stirring arms is small. This is achieved for a preferred design of the abovementioned type when in formula (I) i is >1 and j=1.

If i is chosen to be prime to $n_2$, complete cleaning of the surface areas of the eccentric smaller rotor is retained.

The number of stirring blades is reduced where j>1. Where j is prime to $n_1$, the cleaning of the stirring arms of the central rotor is retained. However, the stirring shaft of the smaller rotor is no longer completely cleaned.

In a further variant of the mixer, the drive for the eccentric stirrer is arranged at the opposite end of the housing to the drive of the central stirrer.

A mixer in which the stirring blades and the stirring arms brush completely over one another, with the exception of their end faces, during their rotation brought about by their drives, and wherein the end faces optionally brush over the inside wall of the housing, is particularly preferred. If self-cleaning of the mixer that is as complete as possible is not crucial, but the only aim is to utilize the particularly short mixing time, the geometry of the mixer can be simplified somewhat. For example, concave or convex surface areas may be approximated by straight surface areas.

A preferred mixer wherein stirring arms are arranged on both the top and bottom sides of the transverse beams, and wherein at least one additional eccentric stirrer is arranged in the housing in the region beneath the transverse beams, also has a stable design. While maintaining the same container height, the length of the stirring arms is halved.

If the mixer is only partially filled with a product to be mixed and all the parts touched by the product are to be kinematically cleaned, the transverse beams of the central stirrer should be fitted in the gas space. It is then correspondingly preferred that the eccentric shaft be driven from below.

In first trials with mixers of the stirrer geometry according to the invention it was found that the mixing times of these mixers are considerably shortened in comparison with comparable, conventional stirring mechanisms (helical stirrers).

The mixing action in the region of the transverse beams can be further improved and the housing wall lying opposite the transverse beams can be kept free of possible contaminants if, in a preferred configuration of the invention, the transverse beams have on their side directed towards the housing wall additional grooves or ridges which have a conveying action in the radial direction, i.e. in the direction of the stirrer shaft or away from the latter.

The same effect is brought about by a corresponding spiral geometry of the transverse beams, which is used in a preferred configuration of the invention.

In a preferred variant of the mixer, the outer surface of the stirring arms is inclined at an angle $\alpha$ of at least 10°, preferably at least 20°, and smaller than 80°, and particularly preferably of at least 30° and smaller than 60° to the radius to the central stirrer and it therefore points towards the inner wall of the housing.

As a result, when the stirrers are in operation, they transport the material to be mixed in an outward direction, i.e. towards the wall of the housing.

In a further preferred variant of the mixer, heating or cooling elements can be fitted to the inner wall of the housing.

Otherwise the housing can also itself be provided with cooling or heating devices, such as for example with a double casing or jacket through which heat transfer media can be passed, or with electrical heating spirals, etc.

The mixer according to the invention is suitable for any desired mixing tasks in chemical process engineering, and can also be used as a reactor for stirred reactions.

The size of the housing does not have to be limited to that required to house the internal components according to the invention. For certain processes (degassing) for example, the housing may be of a size that will provide a gas space over the internal stirrer fittings.

A mixer in which the stirring arms of the central stirrer are connected in each case at one of their ends to the drive shaft via transverse beams, while the respective other ends are connected to one another via a reinforcing ring is particularly preferred.

This connection to a ring produces a stiff frame structure for the stirring arms, so that products of higher viscosity (than that which might be possible without a reinforcing ring) can be processed.

BRIEF DESCRIPTION OF THE DRAWINGS

The invention is explained in more detail below by way of example on the basis of the figures, in which.

EXAMPLES

Example 1

Figure 1B:
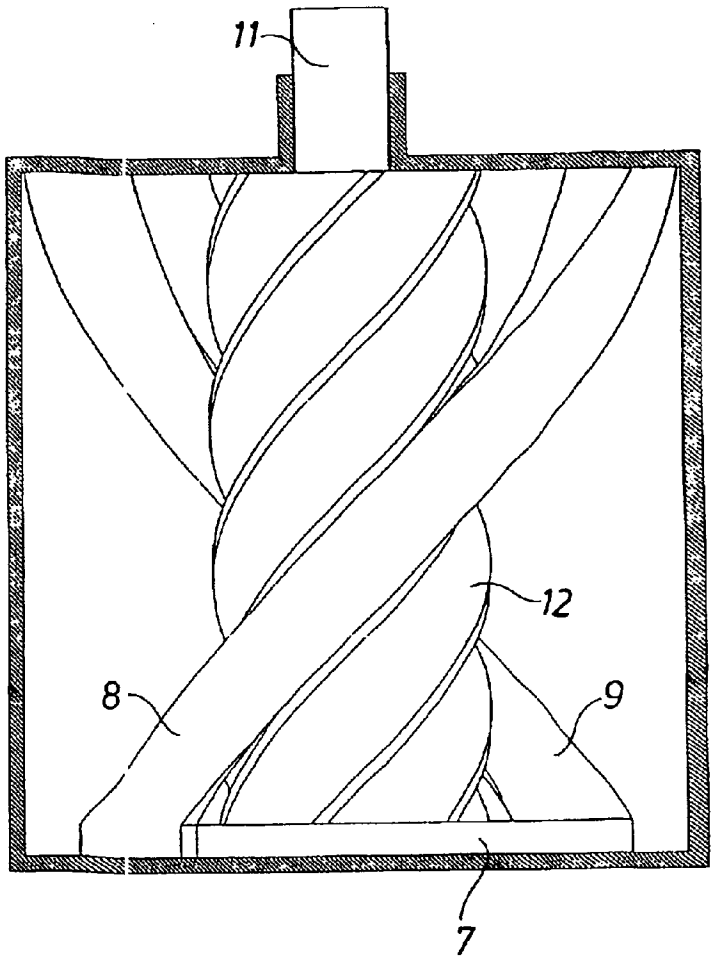
FIG. 1*b* is a side view of the mixer from FIG. 1*a*, the housing again being shown in section.
Figure 1A:
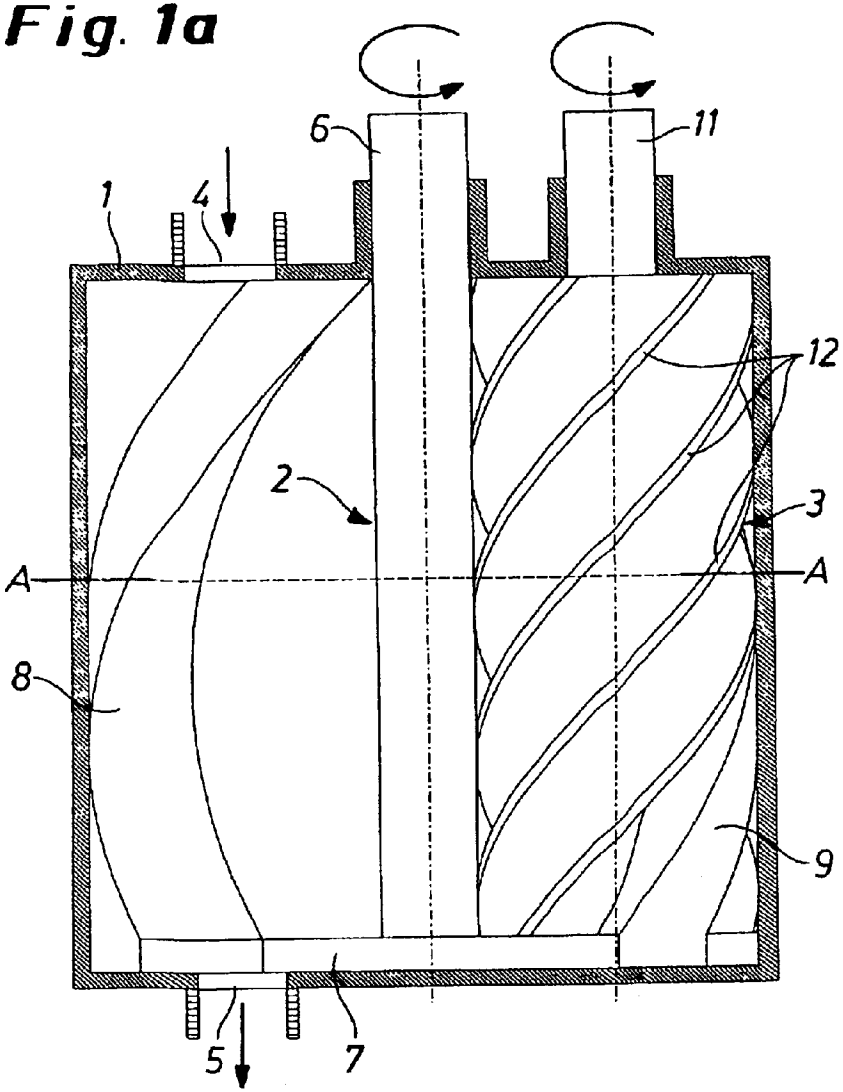
FIG. 1*a* is a front view of a mixer according to the invention; the housing 1 is represented in section.

FIGS. 1*a, b* and *c* are front, side and top views of a mixer according to the invention, in each case with the housing 1 shown in section.

Depicted are the cylindrical housing 1, the central stirrer 2 with a shaft 6 to which two transverse beams 7 which carry the helical stirring arms 8, 9 are attached and the eccentric stirrer 3 with a shaft 11 on which six helical stirring blades 12 are arranged. An inlet 4 and an outlet 5 are fitted at the top and bottom of the housing 1, respectively. The drive units for the stirrers 2, 3 are not drawn.

The stirring blades 12 have an approximately constant thickness, as viewed over the radius. (The thickness is constant in radial section, and it correspondingly increases towards the centre of the rotor perpendicularly to the metal sheet.)

Where $n_1$ is the number of stirring arms 8, 9, $n_2$ the number of stirring blades 12, $\omega_1$ the rotational speed of the central shaft, $\omega_2$ the rotational speed of the eccentric shaft and i and j are natural numbers, the following applies according to formula (I):

$$\frac{\omega_1}{\omega_2} = \frac{n_2 j}{n_1 i}, \tag{I}$$

In the present case, a stirrer geometry in which the numbers denote $n_1=2$, $n_2=6$, $i=7$, $j=1$ has been chosen.

The number i is prime to $n_2$.

Figure 2:
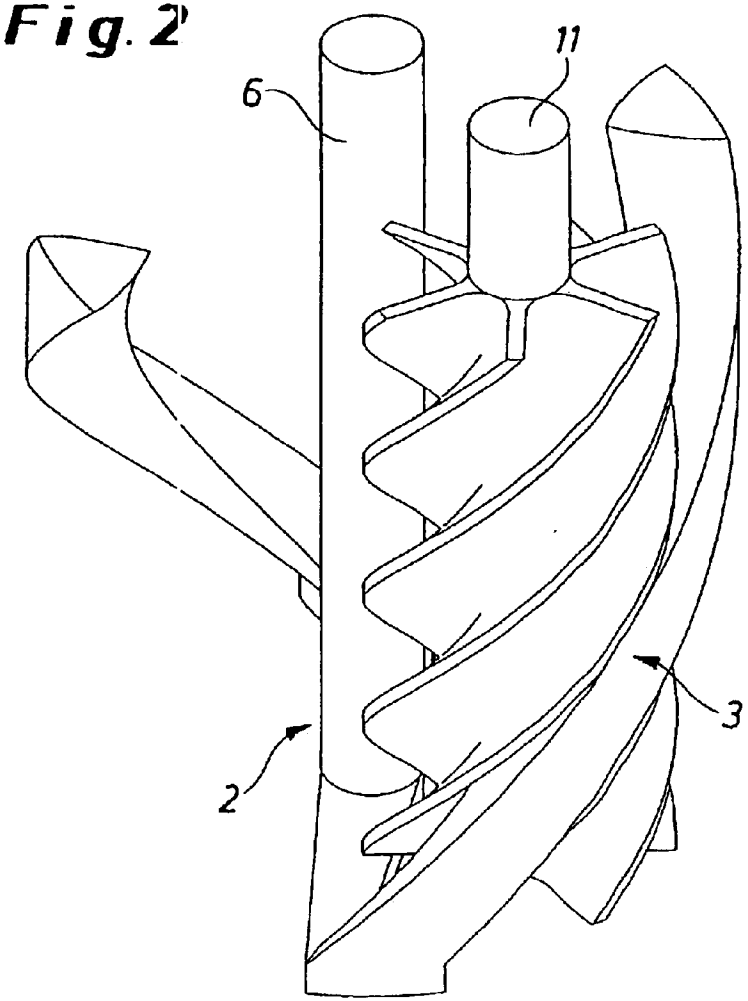
FIG. 2 is an isometric depiction of the stirrers of the mixer from FIG. 1*a*.

FIG. 2 shows the stirrers 2 and 3 in an isometric projection.

Figure 1C:
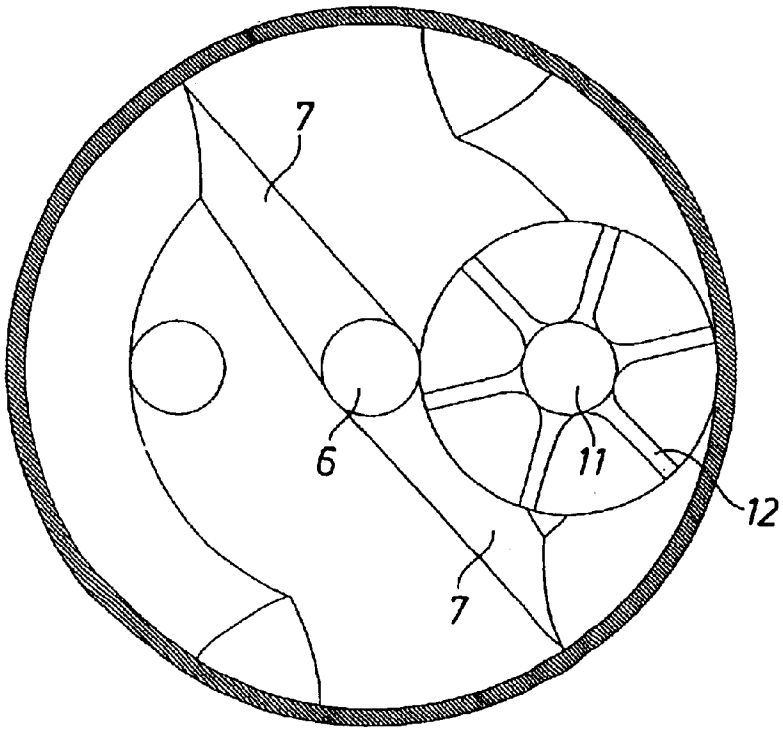
FIG. 1*c* is a top view of the mixer from FIG. 1*a*, the housing again being shown in section.
Figure 3:
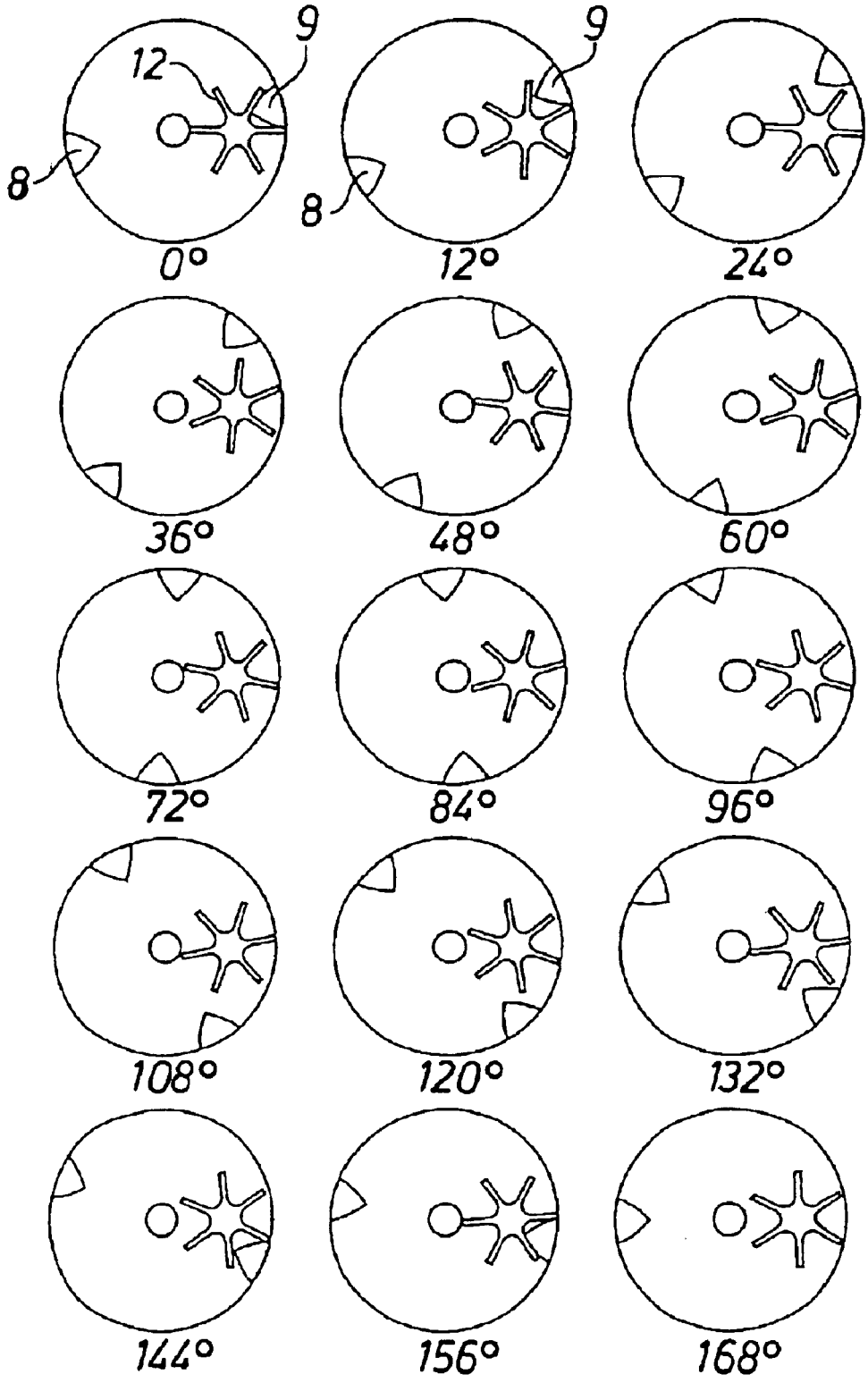
FIGS. 3 shows sectional views of the mixer from FIG. 1*a* along the line III—III in FIG. 1*a* at various points in time during half a revolution of the larger rotor.

FIGS. 3 shows a radial section through the mixer along line III—III in FIG. 1 in 15 different snapshots of the rotation of the two shafts. The respective angle of rotation of the central stirrer 2 is indicated.

Example 2

Figure 4:
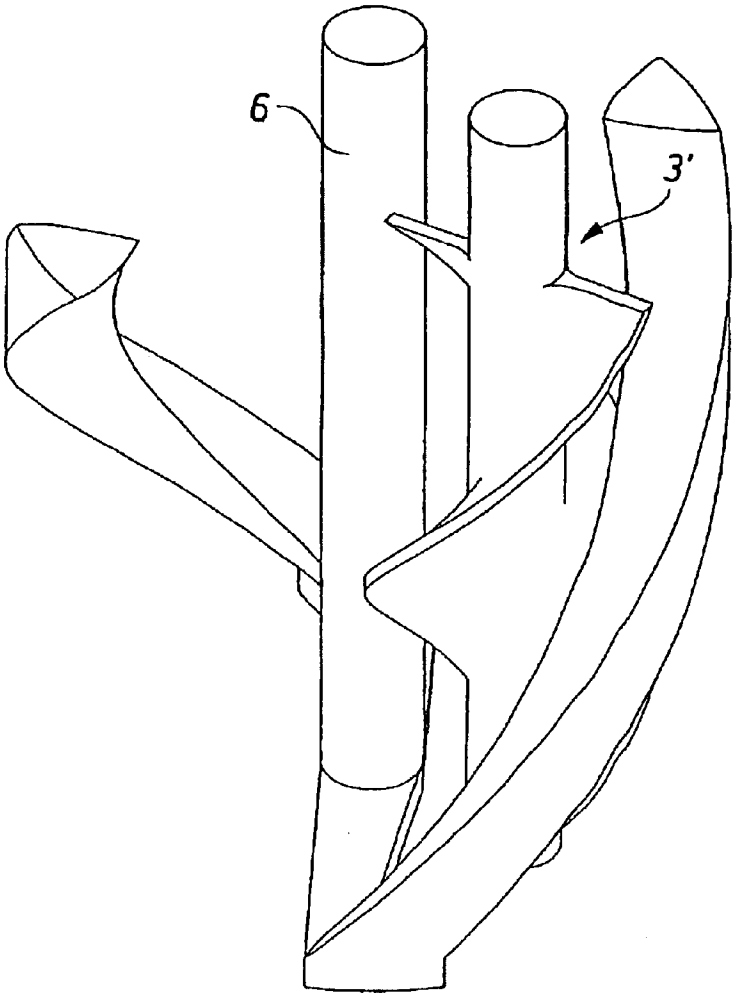
FIG. 4 is an isometric depiction of the rotors of a mixer variant, similar to those shown in FIG. 1*a*, in which however there are only two stirring blades in the case of the smaller eccentric rotor.

FIG. 4 shows a variant of the mixer according to FIGS. 1 and 2, but, on the eccentric shaft 3', four of the stirring blades 12 have been removed. The following again applies:

$$\frac{\omega_1}{\omega_2} = \frac{n_2 j}{n_1 i}, \quad \text{(I)}$$

where $n_1$=2, $n_2$=2, i=7, j=3.

The number i is prime to $n_2$; j is prime to $n_1$.

Figure 5:
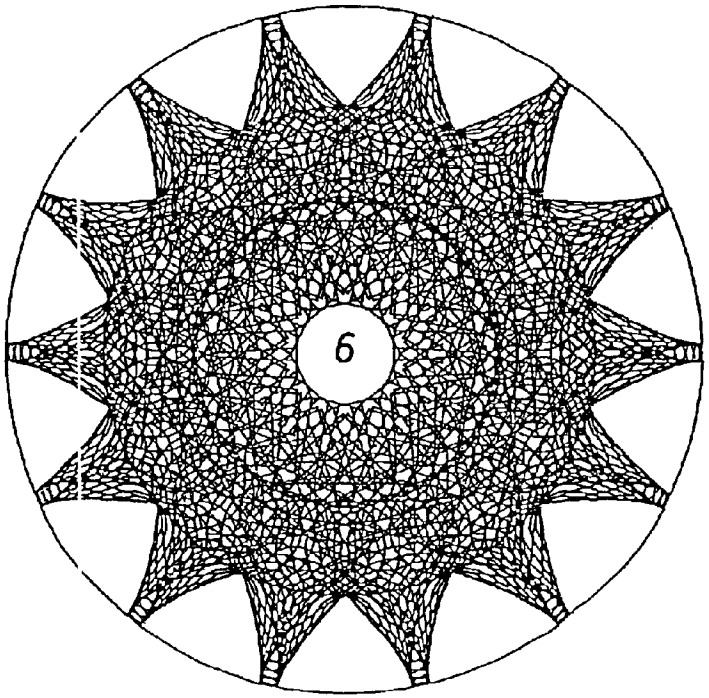
FIG. 5 shows the section along line III—III in FIG. 1*a* through a mixer according to the embodiment of FIG. 4. The relative position of the smaller rotor in relation to the central rotor has been depicted at various points in time in the course of several revolutions (representation of the relative movements).

FIG. 5 shows a radial section through a mixer according to FIG. 4 in snapshots drawn one on top of the other. The larger stirrer 2 was arrested. The relative position of the smaller stirrer 3' was depicted at various points in time in the course of several revolutions.

Figure 10:
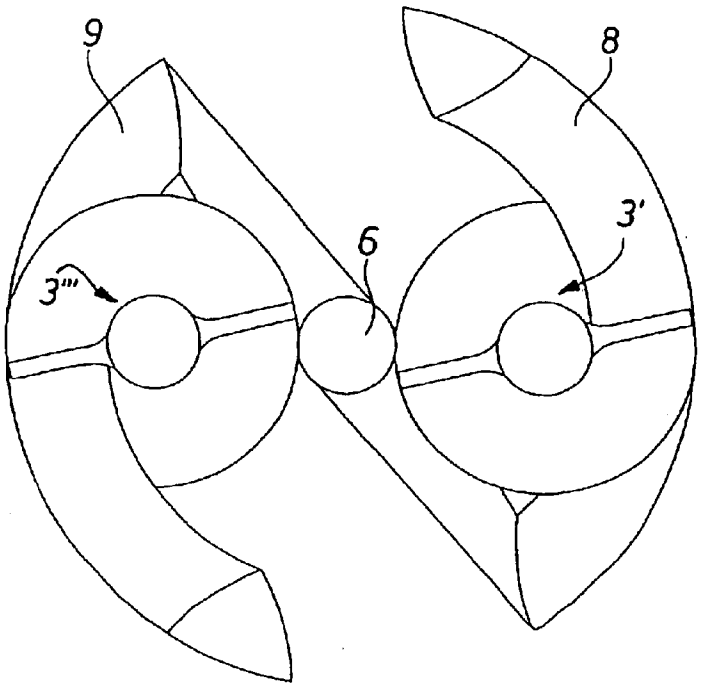
FIG. 10 shows a mixer variant with two eccentric stirrers.

FIG. 10 depicts a modification of the shape of the mixer according to FIG. 4, in which, in cross section, two eccentric stirrers 3" and 3'"are combined with a central stirrer 2.

Example 3

Figure 6:
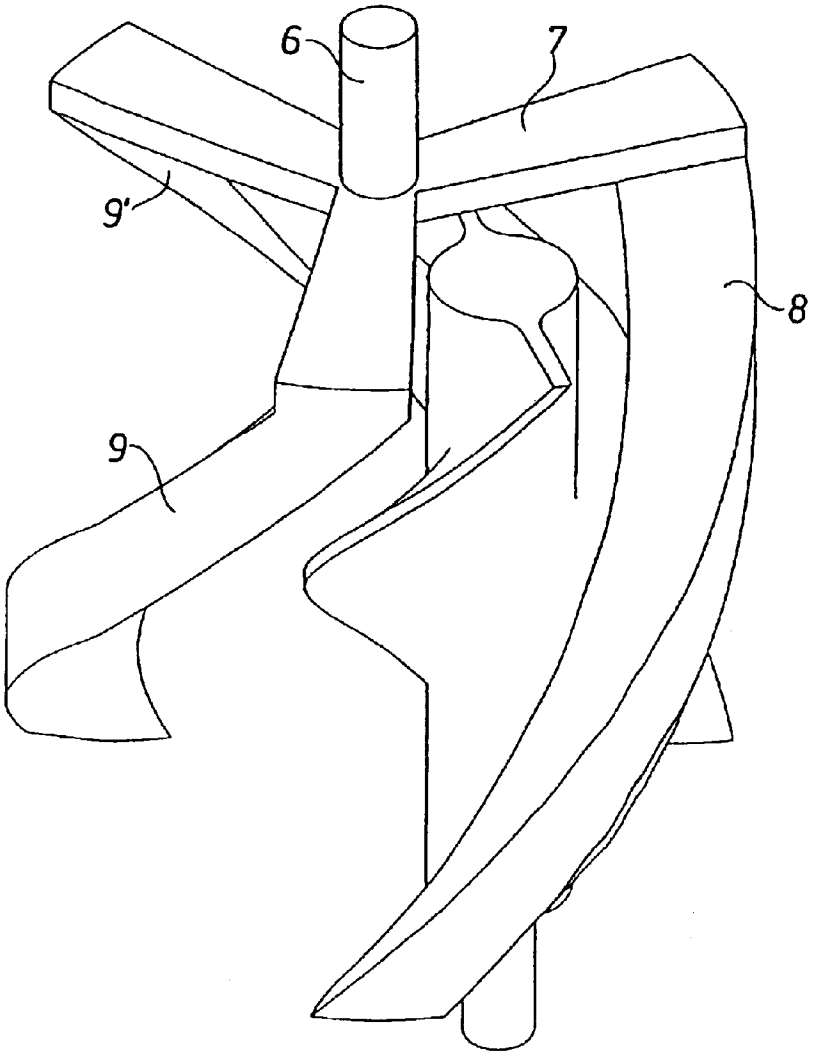
FIG. 6 is an isometric depiction of the rotors of a mixer with the eccentric stirrer being adapted to be driven from below.

FIG. 6 shows a configuration of the mixer with three transverse beams 7 and three stirring arms 8, 9, 9'.

For the rotors in FIG. 6, the following relationship applies:

$$\frac{\omega_1}{\omega_2} = \frac{n_2 j}{n_1 i}, \quad \text{(I)}$$

where $n_1$=3, $n_2$=2, i=5, j=4.

The number i is prime to $n_2$; j is prime to $n_1$.

The eccentric rotor is driven from below.

Example 4

Figure 7:
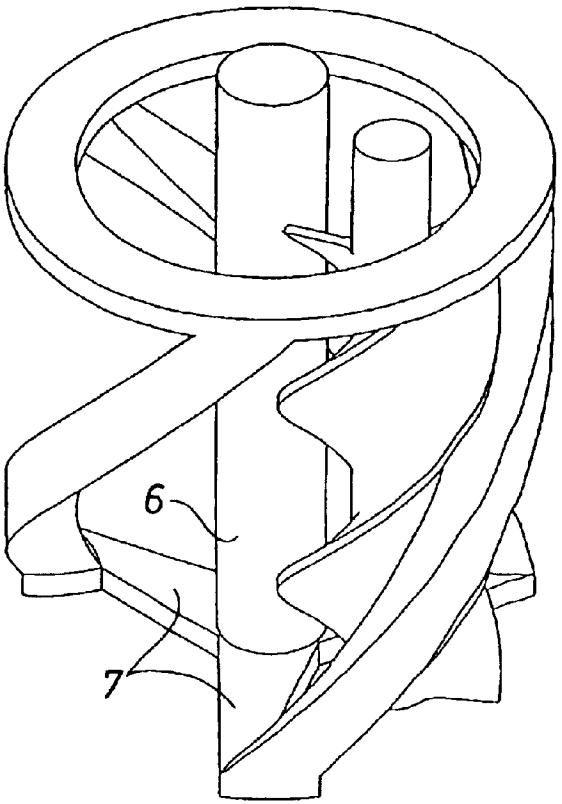
FIG. 7 shows a configuration of a mixer of the invention with a reinforcing ring.

FIG. 7 shows the stirrers of a mixer according to the invention in which the stirring arms of the central stirrer are in each case connected at one end to the drive shaft 6 via transverse beams 7, while the respective other ends are connected to one another via a reinforcing ring 13.

This connection to a ring 13 produces a stiffer frame structure for stirring products of higher viscosity.

The rotational speed ratio is in this case 2:5. The central stirrer carries 3 stirring arms and the eccentric stirrer 3' carries three stirring blades.

For the rotors in FIG. 7, the following relationship also applies:

$$\frac{\omega_1}{\omega_2} = \frac{n_2 j}{n_1 i}$$

where $n_1$=3, $n_2$=3, i=5, j=2.

The number i is prime to $n_2$; j is prime to $n_1$.

Example 5

Figure 8:
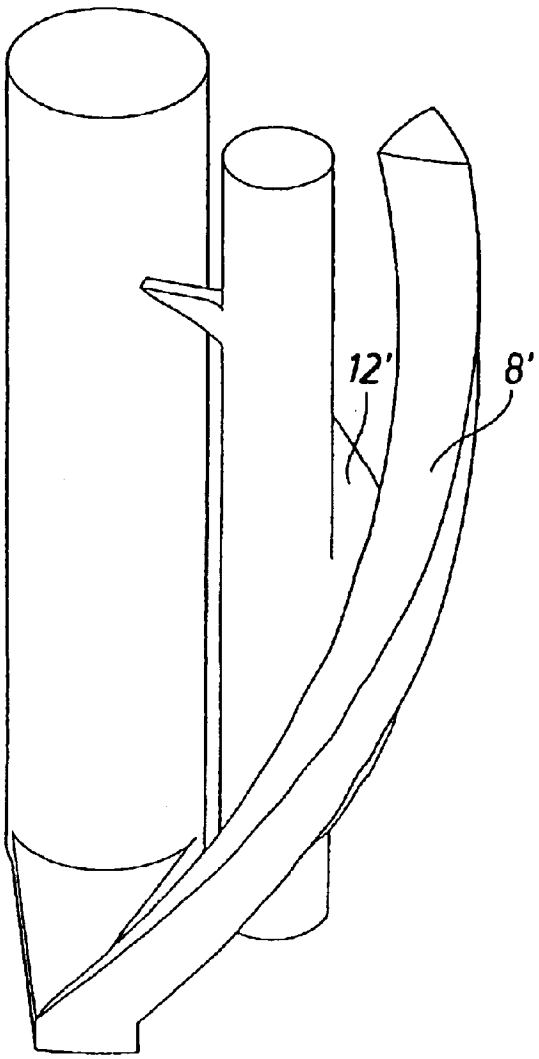
FIG. 8 shows a configurational variant of the mixer according to FIG. 1*a*, but with a stirring arm and a stirring blade.

FIG. 8 depicts the stirrer combination of a mixer with only one stirring arm 8' and one stirring blade 12' on the eccentric stirrer 3.

Figure 9:
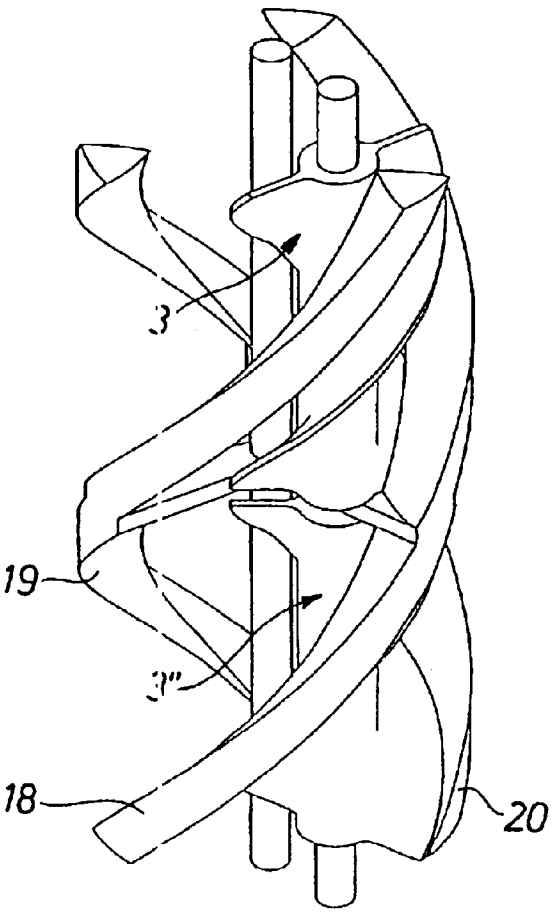
FIG. 9 shows a further configuration of the mixer of the invention with a centrally arranged transverse beam and stirring arms arranged above and beneath the latter.

Depicted in FIG. 9 is a variant of the mixer according to FIG. 6 in which the transverse beams 7 additionally carry further stirring arms 18, 19, 20 on the underside. Fitted in the lower part of the arrangement is a further eccentric stirrer 3", which engages in the stirring arms 18, 19, 20 and is driven from below.

Example 6

Figure 11:
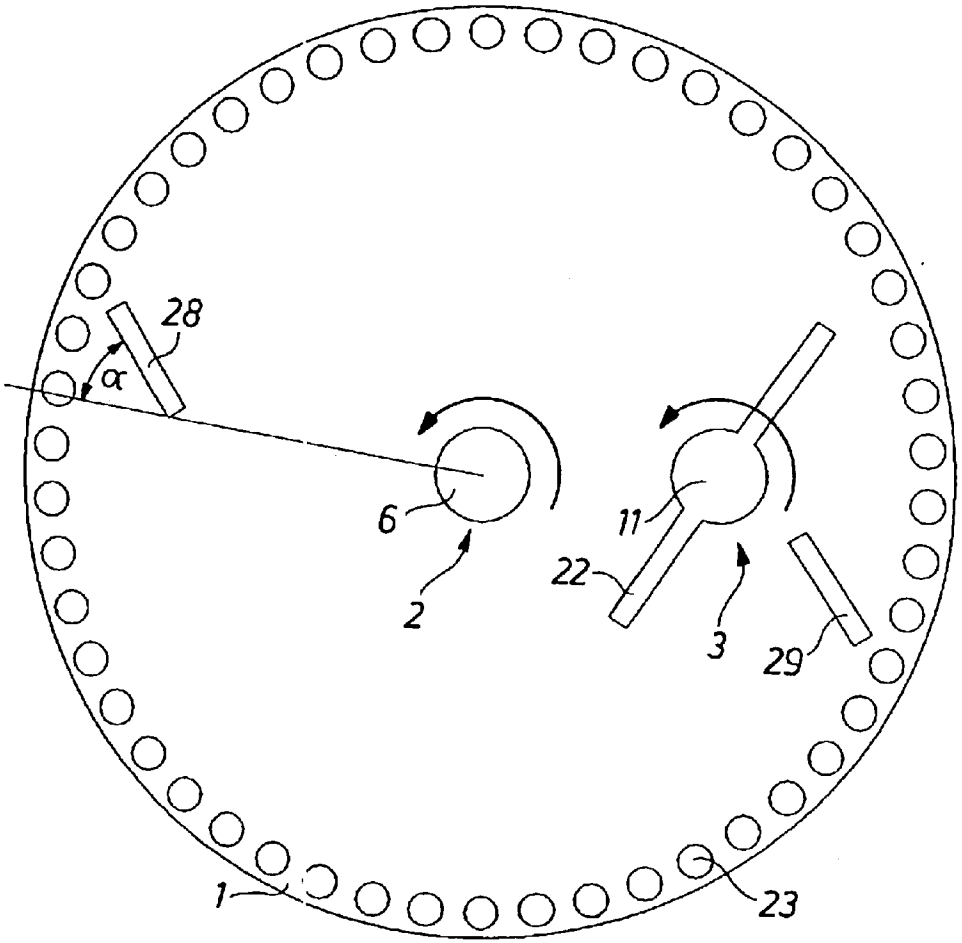
FIG. 11 shows a radial cut through a mixer similar to FIG. 4, but with blade-shaped stirring arms which have a rectangular cross-section.

FIG. 11 shows a radial cut through the stirrers 2 and 3 of one variant of the mixer according to the invention. The design of this mixer corresponds basically to that of the configuration shown in FIG. 4, except that the stirring arms 28 and 29 are blade-shaped and have a rectangular cross-section. The ratio between the speeds of rotation of shafts 6 and 11 is 1:2. The central stirrer 2 has two stirring arms 28 and 29, which are blade-shaped, and the eccentric stirrer 3 has two stirring blades 22. The outer surface of the stirring arms 28 and 29 is in each case inclined at an angle of $\alpha$=45° to the radius.

These forms of stirrers 2 and 3 are particularly suitable for arrangement within a vessel which has heating or cooling coils 23 on its inner wall. If the direction of rotation is adjusted in such a manner that the central stirrer 2 transports the material to be mixed in an outward direction, the material flows intensely against the heating/cooling coils 23. An improvement in the heat transfer to the material to be mixed is thereby achieved.

We claim:

1. A mixer comprising at least a housing (1) with an inlet opening (4) and outlet opening (5), two corotating stirrers (2) and (3) and at least one drive for moving the stirrers (2) and (3), wherein one stirrer (2) is arranged centrally in the housing (1), said stirrer (2) comprising at least a drive shaft (6), at least one transverse beam (7) fitted to the latter with at least one stirring arm (8) attached at one end thereof to said at least one transverse beam (7), and the other stirrer (3) comprises at least a drive shaft (11) and one or more stirring blades (12), and is arranged eccentrically in the housing (1) said stirrers (2) and (3) being adapted to rotate and brush said one or more stirring blades (12) and said at least one stirring arm (8) over one another, with the exception of their end faces.

2. A mixer according to claim 1, wherein said stirrers (2) and (3) are adapted to brush said end faces over the inside wall of the housing (1).

3. A mixer according to claim 1 wherein said one or more stirring blades (12) and said at least one stirring arm (8) are helical in shape.

4. A mixer according to claim 3, wherein the helixes of said one or more stirring blades (12) and of said at least one stirring arms (8) are either all right-handed or all left-handed.

5. A mixer according to claim 1, wherein the stirrers (2) and (3) are configured to provide a symmetry of the stirrers (2) and (3) with respect to the rotational speed of their shafts (6) and (11) which conforms to the following mathematical relationship (I):

$$\frac{\omega_1}{\omega_2} = \frac{n_2 j}{n_1 i}, \tag{I}$$

in which $n_1$ denotes the rotational symmetry of the central stirrer (2), $n_2$ denotes the rotational symmetry of the eccentric stirrer (3), $\omega_1$ denotes the rotational speed of the central shaft (6), $\omega_2$ denotes the rotational speed of the eccentric shaft (11) and i and j are natural numbers.

6. A mixer according to claim 5, wherein the number j=1 and the number i=1.

7. A mixer according to claim 5, wherein the number j=1 and i is >1, with i being prime to $n_2$.

8. A mixer according to claim 5, wherein the number j is >1 and the number i is >1, with i being prime to $n_2$ and j being prime to $n_1$.

9. A mixer according to claim 1, wherein said one or more stirring blades (12) have a constant thickness over their radius.

10. A mixer according to claim 1, wherein the drive for the eccentric stirrer (3) is arranged on the opposite side of the housing (1) from the drive for the central stirrer (2).

11. A mixer according to claim 1, wherein said at least one stirring arm (8) of the central stirrer (2) is at least two stirring arms (8,9) which are connected to one another at their ends via a reinforcing ring (13).

12. A mixer according to claim 1 wherein said at least one transverse beam (7) is at least two transverse beams, and additional stirring arms (8', 9') are arranged on the undersides of the at least two transverse beams (7), and at least one additional eccentric stirrer (3') is arranged in the housing (1) in beneath the transverse beams.

13. A mixer according to claim 1, wherein said at least one transverse beam (7) has a spiral geometry, which brings about radial conveyance during the rotation of the stirrers (2, 3).

14. A mixer according to claim 1, wherein grooves or ridges, which bring about radial conveyance during the rotation of the stirrers (2, 3), are provided on the side of the at least one transverse beam (7) facing the inside wall of the housing.

15. A mixer according to claim 1, wherein the outer surface of the at least one stirring arm (8) is inclined at an angle $\alpha$ to the radius of the central stirrer (2) of at least 10°.

16. A mixer according to claim 15, wherein said angle $\alpha$ is at least 20° but less than 80°.

17. A mixer according to claim 16, wherein said angle $\alpha$ is at least 30° and less than 60°.

18. A mixer according to claim 1, wherein heating or cooling elements (23) are fitted to the inner wall of the housing (1).

19. A mixer according to claim 1, 2, 3, 4, 5, 6, 7, 8, 9, 10, 12, 13, 14, 15, or 18 wherein said at least one stirring arm (8) is at least two stirring arms (8,9).

20. A mixer according to claims 1, 2, 3, 4, 5, 6, 7, 8, 9, 10, 11, 13, 14, 15 and 18 wherein said at least one transverse beam (7) is at least two transverse beams.

* * * * *